US008733579B2

(12) United States Patent
Claeys

(10) Patent No.: US 8,733,579 B2
(45) Date of Patent: May 27, 2014

(54) FAST DRAINING WATER HOLDING TANK

(76) Inventor: Jay Claeys, Bartlesville, OK (US)

( * ) Notice: Subject to any disclaimer, the term of this patent is extended or adjusted under 35 U.S.C. 154(b) by 183 days.

(21) Appl. No.: 13/427,652

(22) Filed: Mar. 22, 2012

(65) Prior Publication Data

US 2012/0241448 A1 Sep. 27, 2012

Related U.S. Application Data

(60) Provisional application No. 61/466,830, filed on Mar. 23, 2011.

(51) Int. Cl.
*B65D 33/02* (2006.01)

(52) U.S. Cl.
USPC ..... 220/565; 220/9.3; 220/9.2

(58) Field of Classification Search
USPC ..... 220/9.3, 9.2, 9.4, 9.1, 565, DIG. 6; 4/507, 506
See application file for complete search history.

(56) References Cited

U.S. PATENT DOCUMENTS

| | | | | |
|---|---|---|---|---|
| 2,749,956 | A | 6/1956 | Eldred | |
| 5,746,343 | A * | 5/1998 | Waltke et al. | 220/9.4 |
| 7,905,368 | B1 | 3/2011 | Christensen | |
| 2010/0140263 | A1 * | 6/2010 | Claeys | 220/9.3 |

* cited by examiner

*Primary Examiner* — Stephen Castellano
(74) *Attorney, Agent, or Firm* — Gable Gotwals

(57) ABSTRACT

An improvement to a collapsible liquid holding tank includes a chute which extends outwardly from an opening in one of the tank side walls. The chute is formed by a bottom panel and side walls of collapsible material, the bottom panel perimeter being reinforced by a hinged frame which swings between "vertical" and "horizontal" conditions in which the opening is "closed" and "opened," respectively. A clamp hinged on the top rail of the tank secures the chute in the "closed" condition in which the bottom panel of the chute extends across the opening. To drain the tank, the clamp is rotated clear of the frame and the chute is swung to the "opened" condition by the weight of the liquid in the tank.

7 Claims, 3 Drawing Sheets

FAST DRAINING WATER HOLDING TANK

CROSS-REFERENCE TO PENDING APPLICATIONS

This application claims priority to U.S. Provisional Patent Application No. 61/466,830.

BACKGROUND OF THE INVENTION

This invention relates generally to liquid storage tanks and more particularly concerns portable high-volume tanks for storing water to be used in emergency situations, such as fighting fires.

It is a common practice to use portable water storage tanks in fighting fires where no natural reservoir is available. It is often desirable and sometimes critical that the portable tanks be rapidly collapsed for removal, either because the fire-fight is ended or because the tank needs to be relocated to a different site to fight the same or a different fire. Often the tank needs to be moved before its stored water has been fully discharged. Draining the tank is typically accomplished by use of a drain hole near or in the tank bottom and collapsing the tank liner toward the drain hole to shift the remaining water toward the drain. Depending on the remaining water volume, the process can be quite time consuming.

It is, therefore, an object of this invention to provide a high-volume portable water storage tank that can be very rapidly drained. It is also an object of this invention to provide a rapidly drainable high-volume portable water storage tank having a discharge structure that will not compromise the water storage integrity of the tank.

SUMMARY OF THE INVENTION

In accordance with the invention, a high-volume portable water storage tank is provided which can be very rapidly drained. At least one collapsible chute is integrated into one or more sides of the tank liner, each such chute being held by one or more fasteners in an upright condition so as to complete the liner side wall for storage of water in the tank. Upon releasing of the fasteners, the chute unfolds under the force of the water remaining in the tank to create a wide and substantially tank top to tank bottom opening, permitting the remaining water to be discharged from the tank through the chute.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

Figure 1:
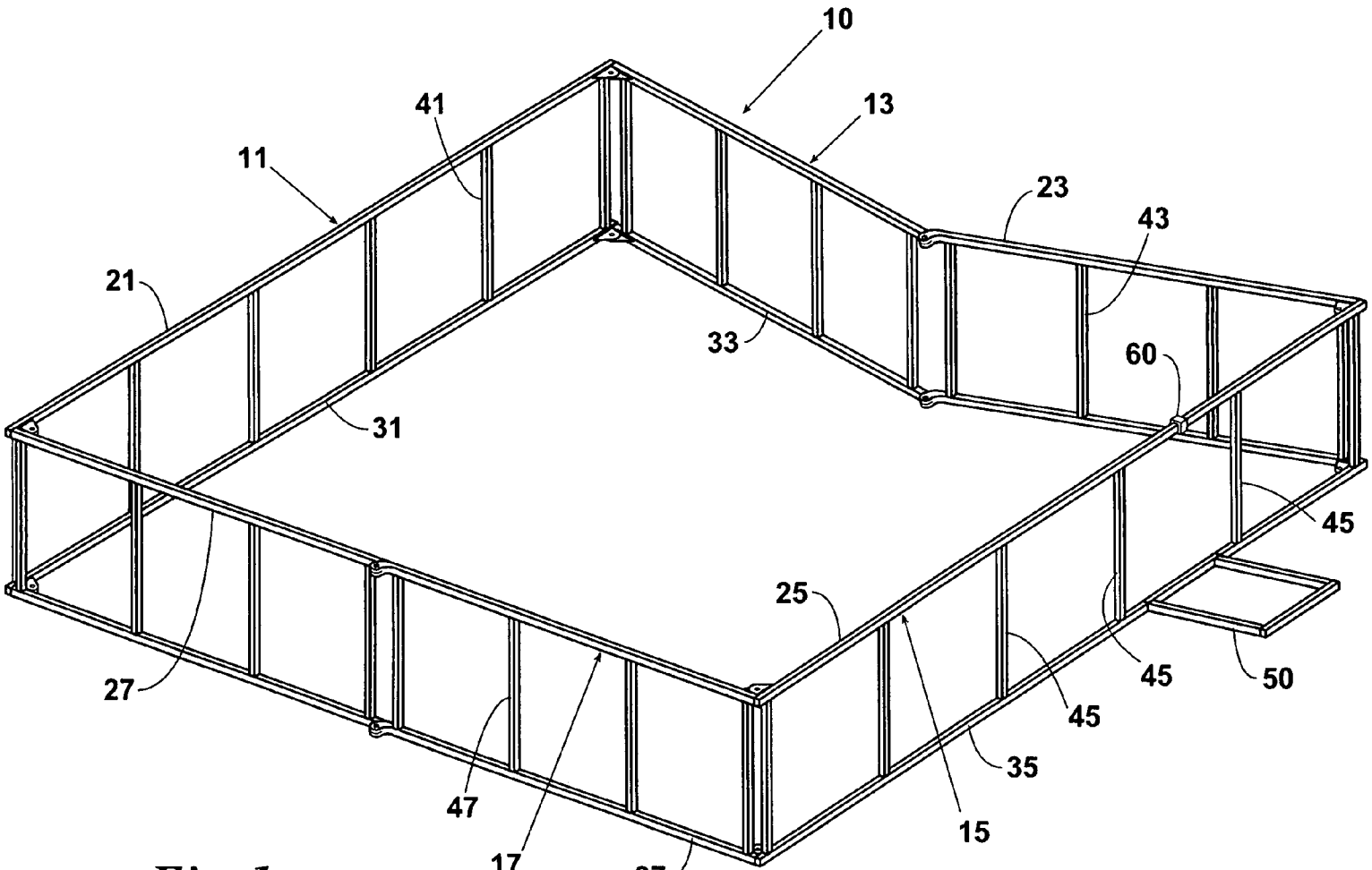
FIG. 1 is a perspective view of a preferred embodiment of the collapsible frame of the fast draining water holding tank.

Turning first to FIG. 1, the frame 10 of the fast draining water holding tank has four sides 11, 13, 15, 17 with their corners and the middle portions of two opposed sides 13 and 17 being hinged to permit the frame 10 to be opened into or collapsed from its water storage condition. Each side 11, 13, 15, 17 is formed with horizontal top 21, 23, 25, 27 and bottom 31, 33, 35, 37 rails spaced by vertical struts 41, 43, 45, 47. At least one of the sides 11, 13, 15, 17, as shown by one of the unhinged sides 15, includes a hinged drop-down door frame 50 and latch 70 positioned between two adjacent vertical struts 45. The door frame 50 and latch 60 are components of the tank water discharge chute 70 shown in FIG. 2.

Figure 2:
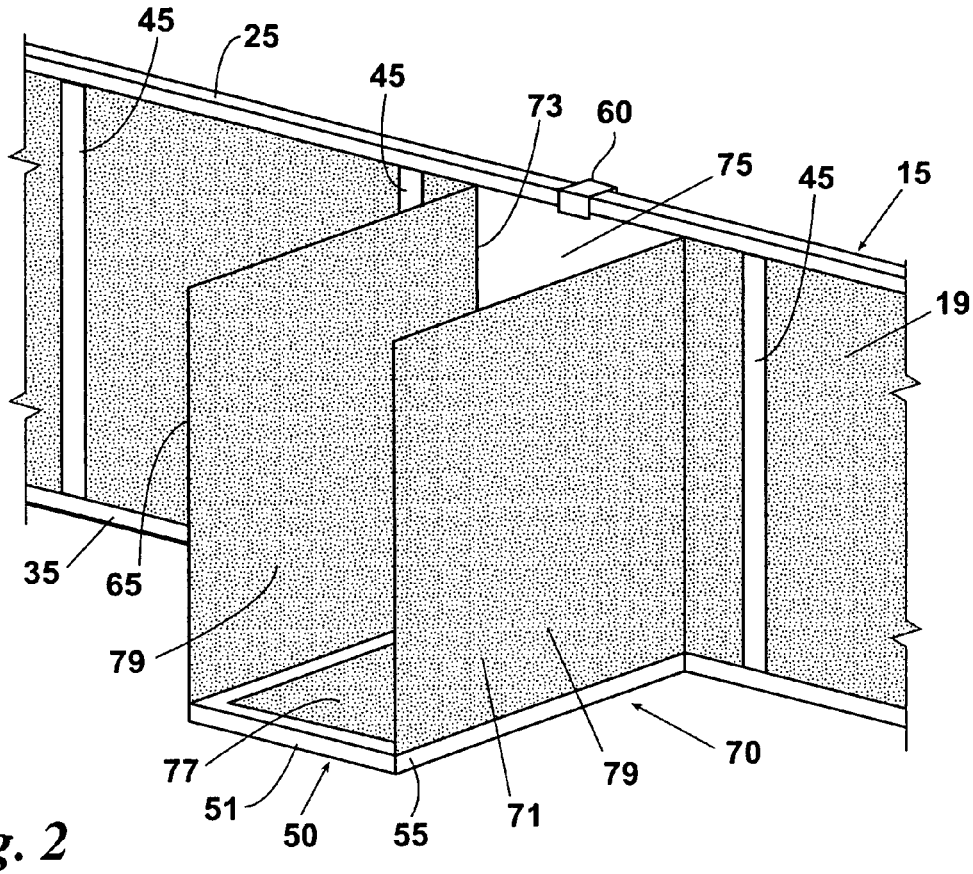
FIG. 2 is an exploded perspective view of the discharge chute of the tank of FIG. 1 opened to its discharge condition.
Figure 3:
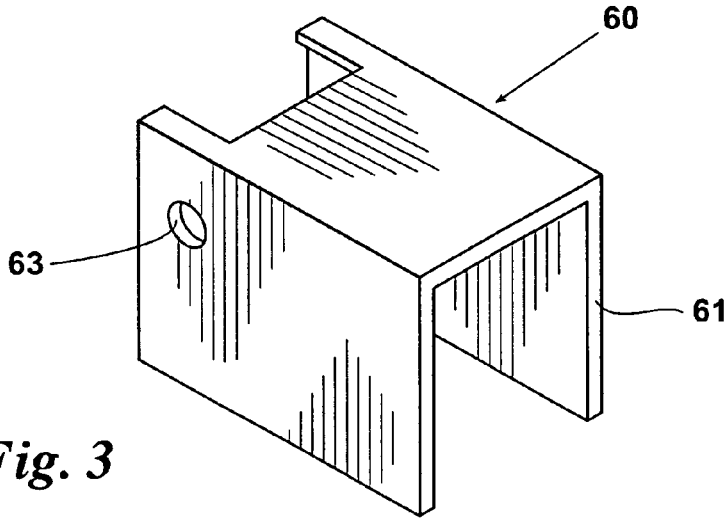
FIG. 3 is an exploded perspective view of the latch of the discharge chute of FIG. 2.
Figure 4:
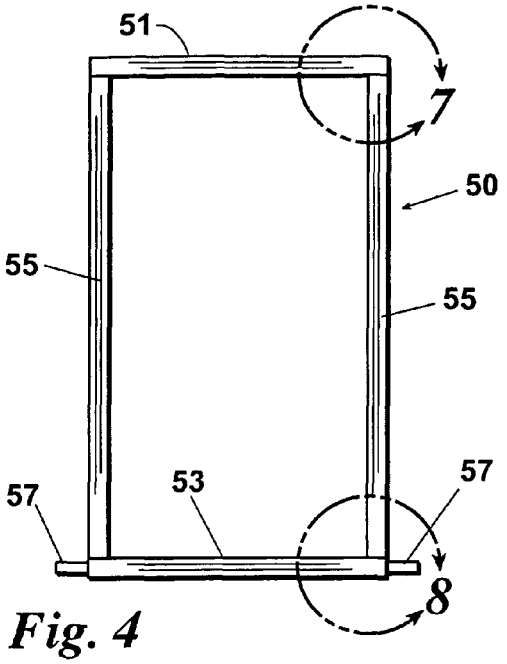
FIG. 4 is a front elevation view of the door frame of the discharge chute of FIG. 2.
Figure 5:
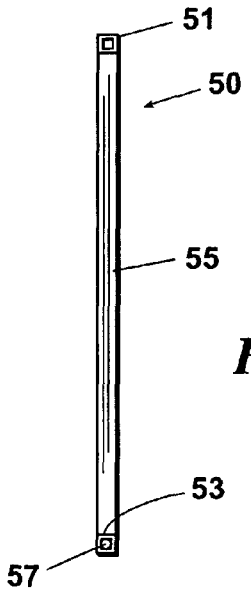
FIG. 5 is a side elevation view of the door frame of FIG. 4.
Figure 6:
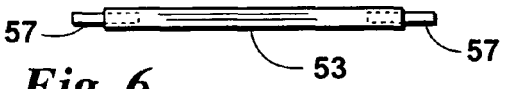
FIG. 6 is a bottom plan view of the door frame of FIG. 4.
Figure 7:
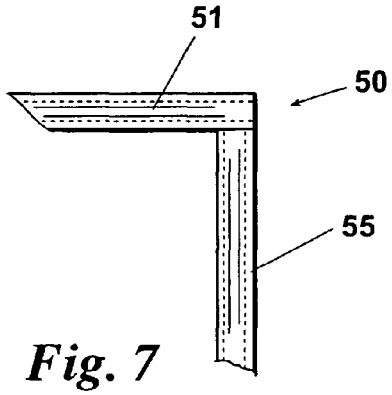
FIG. 7 is an exploded view of the area 7-7 of FIG. 4.
Figure 9:
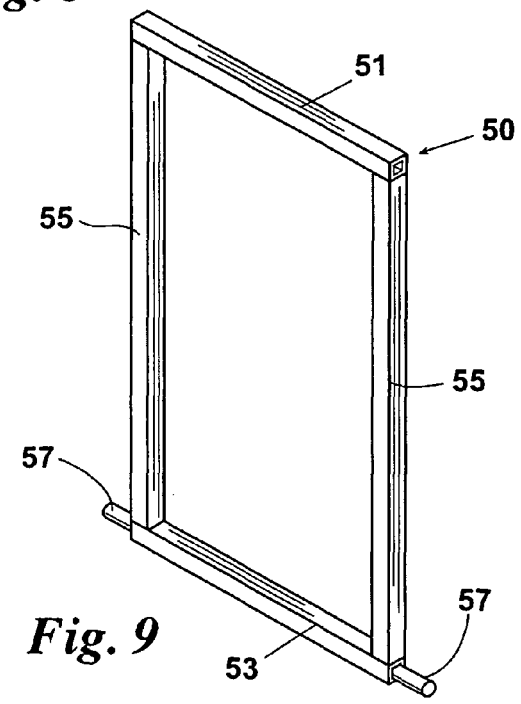
FIG. 9 is a perspective view of the door frame of FIG. 4.
Figure 8:
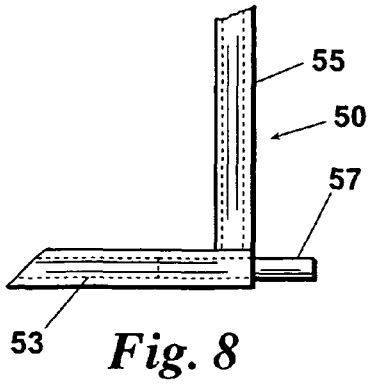
FIG. 8 is an exploded view of the area 8-8 of FIG. 4.

Looking at FIG. 2, the frame 10 supports the collapsible tank liner 19 and the discharge chute 70 is formed by a U-shaped segment of material 71 extended outwardly from the edges 73 of an opening 75 in the tank liner 19. The bottom panel 77 of the U-shaped segment 71 has its perimeter defined and reinforced by the door frame 50. The latch 60, best seen in FIG. 3, is a U-shaped member 61 which is seated on the top rail 25 proximate the middle of the chute opening 75 and is pivotally mounted on a pin (not shown) extending through the top rail 25 and apertures 63 in the latch 60. As shown, the edges of the chute material 71 are doubled over and stitched or sealed 65 for reinforcement but the side walls are foldable flaps 79 which, when the chute 70 is being closed, allow the top outer corners of the chute 70 to be pulled into the tank until the door 50 is upright and the bottom panel 77 of the chute 70 extends across the opening 75.

As seen in FIGS. 4-9, the door frame 50 is formed using top 51 and bottom 53 rails connected by side struts 55 with hinge pins 57 extending outwardly from the door frame bottom rail 53 for engagement in the bottom rail 35 of the tank frame 10, as best seen in FIG. 1. When the door frame 50 is raised so that the bottom panel 77 of the chute 70 closes the opening 75 in the tank liner 19, the latch 60 can be rotated to secure the door 50 in the upright position. The side flaps 79 can be folded back against the side walls of the tank liner 19. The excess flap material may also be secured to the tank liner 19 or frame 10 in the folded back condition by use of hook and loop fasteners or other fasteners such as rope, snaps, buttons or the like (not shown). The storage integrity of the tank is maintained because of the unitary structure of the tank liner 19 and the chute 70. The chute 70 can be employed without a door frame 50 by using hook and loop or other fasteners to not only hold the flaps against the side walls of the liner 19 but also to secure the bottom panel 77 of the chute 70 to, or close to, the top rail 25 of the tank frame.

If it is desired to discharge remaining water from the tank by means of the chute 70, a simple release of the door latch 60 and/or any hook and loop or other fasteners used to hold the chute 70 closed will cause the chute 70 to be opened by the force of the water remaining in the tank. Once drained, the door 50 and/or chute 70 can be reconnected in the upright condition for refilling of the tank. The door structure and chute materials can be arranged to allow opening in a direction other than downwardly. The frames 10, 50 can be made of aluminum, steel, plastic or other suitable materials. The preferred door latch 60 would be stainless steel.

Thus, it is apparent that there has been provided, in accordance with the invention, a fast draining water storage tank that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the claims to be appended.

What is claimed is:

1. In a liquid holding tank formed by a collapsible liner having side walls and a floor panel and a foldable frame having horizontal top and bottom rails spaced by vertical struts, the liner side walls being suspended from the foldable frame top rails, an improvement comprising:

a collapsible chute extending outwardly from one of the side walls and the floor panel of the liner and defining an opening in said one of the side walls, said opening extending upwardly from the floor panel and between an adjacent two of the vertical struts, a length of said chute being at least equal to a height of said one of the side walls; and a hinged frame reinforcing a perimeter of a bottom panel of said chute, said hinged frame swinging between "vertical" and "horizontal" conditions in which said opening is "closed" and "opened," respectively.

2. An improvement according to claim 1 further comprising means for securing said chute in said "closed" condition with a bottom panel of said chute extending across said opening.

3. An improvement according to claim 2, said hinged frame having a bottom member hinged for rotation between said adjacent two of the vertical struts of the folding frame.

4. An improvement according to claim 3, said means for securing comprising a latch pivotally mounted on the top rail of the foldable frame proximate a middle of said opening.

5. An improvement according to claim 4, side walls of said chute being foldable flaps which, as said assumes said closed condition, are pulled into the tank until said hinged frame is upright and said bottom panel of said chute extends across said opening.

6. An improvement according to claim 5, said hinged frame having top and bottom members connected by side struts, said bottom member comprising a portion of the tank bottom rail with hinge pins extending outwardly from said bottom member and pivotally engaged in the bottom rail of the foldable frame.

7. An improvement according to claim 6 further comprising one of hook and loop fasteners, ropes, snaps and buttons securing side walls of said chute to one of the collapsible liner and the foldable frame in said "closed" condition.

* * * * *